US007214171B2

(12) United States Patent
Thelen et al.

(10) Patent No.: US 7,214,171 B2
(45) Date of Patent: May 8, 2007

(54) ATHLETIC TRAINING DEVICE

(75) Inventors: Sheila E. Thelen, Lino Lakes, MN (US); Scott A. Thelen, Lino Lakes, MN (US)

(73) Assignee: Sheila Thelen, Inc., Schafer, MN (US)

( * ) Notice: Subject to any disclaimer, the term of this patent is extended or adjusted under 35 U.S.C. 154(b) by 47 days.

(21) Appl. No.: 10/973,876

(22) Filed: Oct. 26, 2004

(65) Prior Publication Data

US 2005/0096201 A1 May 5, 2005

Related U.S. Application Data

(60) Provisional application No. 60/515,859, filed on Oct. 30, 2003.

(51) Int. Cl.
*A63B 21/02* (2006.01)

(52) U.S. Cl. ..... 482/124; 482/121; 482/122

(58) Field of Classification Search ..... 482/124, 482/121, 122
See application file for complete search history.

(56) References Cited

U.S. PATENT DOCUMENTS

| | | | | | |
|---|---|---|---|---|---|
| 843,478 | A | * | 2/1907 | Muller | 482/124 |
| 2,160,722 | A | * | 5/1939 | Cunningham | 482/79 |
| 2,498,006 | A | | 2/1950 | Ridill | 273/35 |
| 3,589,721 | A | * | 6/1971 | Cronauer | 482/125 |
| 3,752,474 | A | | 8/1973 | Macabet et al. | 272/80 |
| 3,838,852 | A | | 10/1974 | Gury | 272/82 |
| 4,033,580 | A | * | 7/1977 | Paris | 482/122 |
| 4,121,827 | A | | 10/1978 | Weider | 272/137 |
| 4,245,840 | A | * | 1/1981 | Van Housen | 482/124 |
| D263,613 | S | | 3/1982 | Henry | D21/198 |
| 4,728,103 | A | * | 3/1988 | Fulton | 482/125 |
| 4,955,608 | A | | 9/1990 | Dougherty et al. | 273/29 |
| 5,133,700 | A | | 7/1992 | Braathen | 482/51 |
| 5,263,916 | A | | 11/1993 | Bobich | 482/124 |
| 5,340,110 | A | | 8/1994 | Mollis | 273/187 |
| 5,372,565 | A | * | 12/1994 | Burdenko | 482/124 |
| D368,501 | S | | 4/1996 | Woodruff | D21/198 |
| 5,518,486 | A | * | 5/1996 | Sheeler | 482/131 |
| 5,545,113 | A | * | 8/1996 | Bobich | 482/125 |
| 5,688,213 | A | * | 11/1997 | Recker | 482/125 |
| D396,077 | S | | 7/1998 | Heine | D21/191 |
| 5,816,952 | A | | 10/1998 | Blevins | 473/450 |
| 6,368,258 | B1 | * | 4/2002 | Emlaw | 482/124 |
| 6,551,221 | B1 | * | 4/2003 | Marco | 482/74 |
| 2003/0130098 | A1 | * | 7/2003 | Marco | 482/124 |

* cited by examiner

*Primary Examiner*—Stephen R. Crow
*Assistant Examiner*—Arun S. Chhabra
(74) *Attorney, Agent, or Firm*—Haugen Law Firm PLLP

(57) ABSTRACT

A training device for figure skaters and other athletes includes an elongate bungee-type cord, and a clipping mechanism with two normally closed loops secured to one end of the cord. At the other end, the cord is secured to itself to form a loop designed to accommodate the user's wrist. With the loop on the wrist and with the other end of the cord secured to the skate or other footwear by the clipping mechanism, the user practices gliding, spinning, twisting, or jumping maneuvers. The elasticity of the cord is selected to provide a gentle tensile force that guides the relative positioning of the linked hand and foot as the maneuvers are performed, to positively reinforce the correct positioning for the maneuvers.

23 Claims, 6 Drawing Sheets

ATHLETIC TRAINING DEVICE

This application claims the benefit of priority based on Provisional Application No. 60/515,589 entitled "Athletic Training Device," filed Oct. 30, 2003.

BACKGROUND OF THE INVENTION

Advances in the figure skating and other sports have been achieved through improved coaching techniques, better equipment, sports medicine and nutrition. In figure skating, primary emphasis is now placed on the use of training techniques and fixed equipment intended to reinforce the skater's proper upper and lower body position, and the use of the skater's muscle memory. To date, skaters have relied on the ability of a coach to observe their movements and effectively communicate (typically verbally) suggestions for improvement. This after-the-fact feedback from a coach requires frequent and intensive time with the coach. Also, training harnesses have been used to a certain extent.

A variety of exercising devices are known to involve couplings between the hands and feet of users. Examples are seen in the following U.S. patents: U.S. Pat. No. 2,160,722 (Cunningham); U.S. Pat. No. 3,752,474 (Macabet, et al.); U.S. Pat. No. 4,121,827 (Weider); U.S. Pat. No. 5,263,916 (Bobich); and U.S. Pat. No. 5,545,113 (Bobich). The exercise device in the '113 patent features clips for convenient attachment to laced athletic shoes of the user. Other devices featuring loops or handles at the opposite ends of an elastic cord or other elongate member, include: U.S. Pat. No. 3,589,721 (Cronauer); U.S. Pat. No. 3,838,852 (Gury); U.S. Pat. No. 263,613 (Henry); U.S. Pat. No. 368,501 (Woodruff); and U.S. Pat. No. 396,077 (Heine).

The devices described in the foregoing patents typically use resistance cords to strengthen muscles and provide aerobic workouts. The resistance of the cord is a substitute for a physical weight. Although these patents do not specify the tensile strength of their cords, the purpose of muscle strengthening typically requires cord sizes (particularly diameters) greater than ½ inch (12.7 mm), increasing with the desired amount of resistance. The sizes of end members such as handles and wrist straps in these devices are consistent with a relatively high tensile force in the cord or other resilient member.

Other patents show the use of a resilient cord said to teach muscle memory and influence the position of an athlete toward a desired correct position. Specifically, U.S. Pat. No. 4,955,608 (Dougherty et al.) discloses an athletic movement trainer including a belt and ankle straps that hold a resilient, bungee-type cord in place to add resistance for the lower body and leg muscle groups. The Dougherty device is directed to maintaining a bent-knee position with the feet firmly in place on a playing surface (e.g. for tennis). The cord is connected to the waist through a ring, and is then stretched down the back of the legs to the ankle straps. The cord is slack while the user maintains the correct position, but becomes tensioned when the user deviates from that position. The device is connected to both legs, and is confined to lower body training needs. Dougherty does not mention gliding sports such as figure skating, or stretching and twisting sports such as figure skating, dance, gymnastics, or diving.

U.S. Pat. No. 6,551,221 (Marco) is directed to a device intended to encourage a bent-knee position for gliding sports, such as skating. This device includes a belt and clips to mount bungee-type cords to the belt clips. Similar clips mount the cords to skates or other footwear. The Marco device places the cords in front of the athlete. The bungee-type cord is functionally focused on the lower body, and would interfere with movements and positions used in most figure skating maneuvers such as single foot-straight leg glides, jumps or spins.

Although the foregoing devices may be well suited for their respective purposes, they either involve the high levels of tensile resistance associated with muscular exercise and stress; or, as in the case of Dougherty and Marco, they use cord tension to discourage deviation from a desired position associated with a slack cord. Thus, they fail to provide an alignment or placement of a properly tensioned resilient cord in a manner that affords a high degree of freedom of movement while reinforcing and teaching proper positioning in the performance of jumps, spins, single foot-straight leg glides, and other movements intended to exhibit grace and style.

Therefore, it is an object of the present invention to provide a training device for reinforcing correct relative positioning of the extremities during maneuvers that emphasize grace and style, and accordingly require considerable freedom of movement.

Another object is to provide an athletic training device that can be attached quickly and conveniently to or close to a user's hand and foot, and that is simple and easy to use in practicing a wide variety of athletic maneuvers involving glides, jumps, twists, or spins.

A further object is to provide a process for practicing athletic maneuvers that affords freedom of movement yet gives the user immediate feedback and encouragement toward correct relative positioning of the extremities for each maneuver being practiced.

Yet another object is to provide a training device that incorporates an elastically extensible component adapted to exert a substantially uniform, low-level tensile force over multiple repetitions of a given maneuver.

SUMMARY OF THE INVENTION

To achieve these and other objects, there is provided a training device for reinforcing a desired relative positioning of extremities during a gliding, spinning, twisting or jumping maneuver. The device includes an elongate tension member having a nominal length when in a relaxed state. The nominal length is selected relative to a user for an extension of the tension member, when in the relaxed state, from the user's foot at least to the user's waist. A first coupling structure is adapted to releasably couple a first end of the tension member proximate to and with respect to a selected foot of the user. A second coupling structure is adapted to releasably couple a second end of the tension member proximate to and with respect to a selected hand of the user and thereby cooperate with the first coupling structure to operatively link the selected hand and selected foot through the tension member. The tension member is extensible elastically, through relative movement of the selected hand and the selected foot when so operatively linked, at least to a predetermined level of elongation corresponding to a maximum distance between the selected hand and the selected foot during a maneuver. The tension member exerts a tensile force that increases with tension member elongation to an upper-level tensile force corresponding to the predetermined level of elongation. The tension member has an elasticity selected such that the upper-level tensile force is less than a tensile force necessary for any substantial muscle exercise or muscle stress, whereby the tension member when elongated during the maneuver, tends to guide the selected hand and the selected foot toward a desired relative positioning with minimal impact on freedom of movement.

The purpose of the training device is to guide an athlete into the proper body position while the athlete is performing a maneuver, without restricting movement. To this end, the device provides slight resistance, through a bungee cord or other tension member attached with respect to the extremities. When the hands and feet are in a position of least resistance, the athlete has achieved the proper body position. In this manner the device provides an alignment "reminder" to maintain proper positioning of the upper body, lower body, and extremities. After repeated use of this device, the athlete's muscles "remember" the proper position and tend to return to that position while the maneuver is being performed. Once the athlete achieves initial understanding and control, more advanced maneuvers can be performed with strength and style.

The capability to guide and train skaters and other athletes in this manner results from providing bungee-type cords or other elongate tension members with the correct length and resilience. With regard to cord length, the tension member in the relaxed state should reach from the foot to the user's waist or slightly beyond. If a given tension member is too long, it is conveniently adjusted in length, simply by winding the tension member an additional turn about the foot. With regard to resilience, the device of the present invention utilizes a cord or other tension member with a tensile force much lower than that considered necessary for muscle strengthening and exercising applications. For example, a cord constructed according to the present invention may require a force of less than five pounds, more preferably less than three pounds, and even more preferably one pound of tensile force to achieve a one-foot (30.5 cm) elongation in a cord with a relaxed-state length of three feet (91.5 cm). In other words, a one-third (approximately 33%) elongation may require in the range of one to five pounds of tensile force.

More generally, resilient cords or other tension members exhibiting relatively low levels of tensile force, while not constructed to exert forces sufficient for significant muscle strengthening, are particularly well suited for encouraging the skater or other athlete by guiding him or her toward the correct positions in a variety of maneuvers. It has been found, in connection with a variety of athletic maneuvers but particularly for the spins, glides and jumps in figure skating, that the proper positions of the arms and legs, and of feet and hands relative to each other, substantially coincide with minimum levels of tension in the cord or other tension member. Thus, the natural tendency to move the arms and legs toward reduced tension, also moves the arms and legs toward the desired position in the maneuver.

When elongated, the tension member generates or exerts a tensile force that increases with elongation. In other words, an internal elastic restoring force acts lengthwise along the cord, tending to draw the cord back to the nominal, relaxed-state length. When operatively linking an athlete's hand and foot, the tension member when elongated tends to draw the linked hand and foot toward one another.

The present training device uses tension in a positive manner to guide the user toward a correct relative positioning of the extremities, specifically an operatively linked hand and foot. The "relative positioning" takes into account not only the positions of the hand and foot relative to each other, but also their positions with respect to the user's body. The positive use of tension is counterintuitive, and represents a significant departure from conventional devices in which tension is used negatively, i.e. to discourage departure from a correct position associated with slack in the tension member. A key factor facilitating the positive use of tension is the selection of tension members with low elastic moduli, i.e. elasticities that allow substantial elongation while generating a low tensile forces.

The much higher tension levels in muscle exercising devices, while suitable for their intended purposes, would exert unduly high levels of tension upon skaters and other athletes attempting spins, twists, glides and leaping maneuvers, and thus would run counter to the type of training achieved by the present device, which affords maximum freedom of movement in combination with a relatively gentle application of tensile force.

An additional advantage is that the present athletic training device is comfortable to wear, quick and easy to attach, and simple and uncomplicated to use. This enhances the potential of the device to increase the athlete's awareness of posture, alignment, and stretch, while avoiding unnecessary restrictions on the movement of the athlete as he or she engages in a wide variety of movement based sports.

The training device is particularly well suited for skaters. In this regard, the resilient cord or other tension member is adapted at one end to receive a clip, preferably with at least two spring-loaded closure members, each tending to close a loop but movable against the spring force to open the loop. In use, a first one of the loops is releasably attached to the laces of the user's skate. Then, the cord is wrapped about the skate, threaded through the opening above the blade and below the boot portion of the skate, and releasably received into the second loop of the clip.

This approach to attachment achieves an advantageous combination of convenience and stability. The loop attached to the laces is not relied upon for cord-securing strength, but simply to prevent the clip from sliding with respect to (and possibly off) the skate. The primary holding force is exerted by the cord itself, enhanced by its threading through the other loop of the clip. The result is a convenient attachment to the skate without exerting undue force upon the laces.

Further in accordance with the present invention, there is provided a training device for reinforcing a desired relative positioning of extremities during a gliding, spinning or jumping maneuver. The device includes an elongate elastically extensible tension member having a nominal length when in a relaxed state. A first coupling structure is adapted to releasably couple a first end of the tension member proximate to and with respect to a selected foot of a user. A second coupling structure is adapted to releasably couple a second end of the tension member proximate to and with respect to a selected hand of the user and thereby cooperate with the first coupling structure to operatively link the selected hand and foot. The tension member is elastically extensible at least to a predetermined length of 1.8 times the nominal length, exerts a tensile force that increases with tension member elongation, and has an elasticity selected such that when at the predetermined length, the tension member generates a tensile force of less than fifteen pounds.

Another aspect of the present invention is a process for practicing an athletic maneuver involving a predetermined relative positioning of the extremities, including:

a. selecting a first tension member having a relaxed-state length sufficient for extension from a user's foot to at least the user's waist, elastically extensible and thereby generating a tensile force that increases with elongation, and having a selected elasticity such that the tensile force at eighty percent elongation is less than fifteen pounds;

b. releasably securing a first end of the first tension member proximate to and with respect to a first foot of the user;

c. releasably securing a second end of the first tension member proximate to and with respect to a first hand of the user, to operatively link the first foot and the first hand; and d. with the first foot and first hand operatively linked, repeating an athletic maneuver involving a relative positioning of the first selected hand and the first selected foot that requires an elongation of the first tension member.

Thus in accordance with the present invention, a tension member operatively coupled between a user's hand and foot applies a light tensile force tending to guide the hand and foot toward a desired relative positioning in a gliding, jumping or spinning maneuver. The device makes use of the natural tendency to move the arm and leg toward the reduced-tension positions, which coincide with the positions desired in performing various maneuvers. Repetition develops the memory of the muscles, so that after multiple repetitions, the arm and leg tend to return to their intended positions, even in the absence of the device.

IN THE DRAWINGS

For a further understanding of the above features and advantages, reference is made to the following detailed description and to the drawings, in which.

DETAILED DESCRIPTION OF THE PREFERRED EMBODIMENTS

Figure 1:
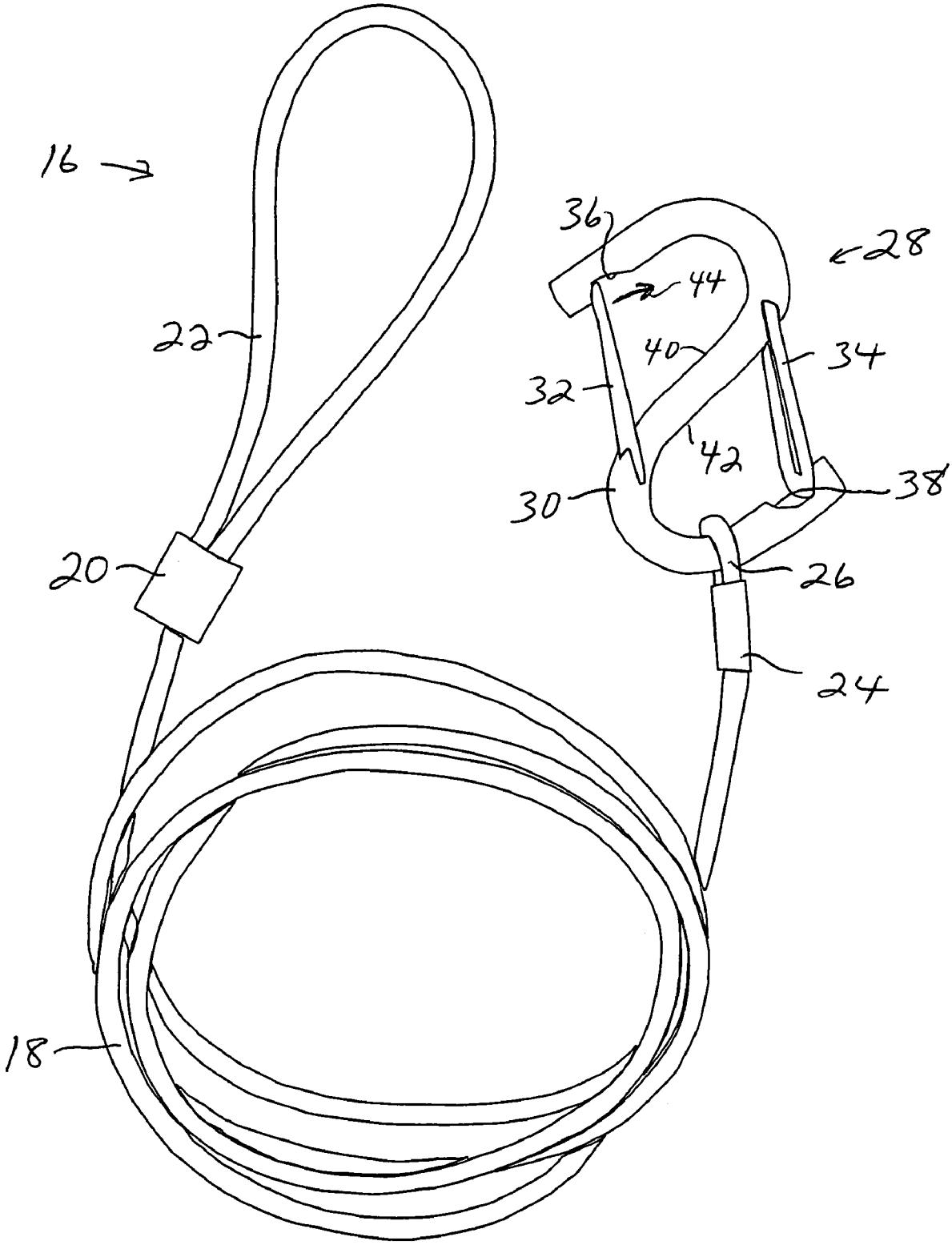
FIG. 1 is a top plan view of a training device constructed in accordance with the invention.

Turning now to the drawings, there is shown in FIG. 1 an athletic training device 16 including a resilient cord or other element 18, preferably a bungee-type cord. Cord 18 is secured to itself at each end, with a fastener 20 to form a larger loop 22, and with a fastener 24 to form a smaller loop 26. Fasteners 20 and 24 preferably are metal sleeves that can be plastically deformed, i.e. squeezed together or crimped to secure the connection. As an alternative to sleeves, fasteners 20 and 24 can include D-rings, knots, sewn connections, or circular rings, preferably formed of metal but alternatively formed of plastic, wood, or ceramic material. Larger loop 22 is expandable to accommodate an athlete's hand therethrough, and in a relaxed (unstretched) state is sized to comfortably accommodate the wrist of the athlete. Smaller loop 26 connects the cord to a clipping mechanism 28. The clipping mechanism includes an S-shaped frame 30, and two spring-loaded closure members 32 and 34 pivotally mounted to the frame. Closure members 32 and 34 are biased into respective notches 36 and 38 formed in frame 30, and cooperate with their associated segments of the frame to form respective normally closed loops 40 and 42. Each closure member can be pivoted inwardly against the spring force in the direction indicated by the arrow 44, to open its associated loop.

Figure 2:
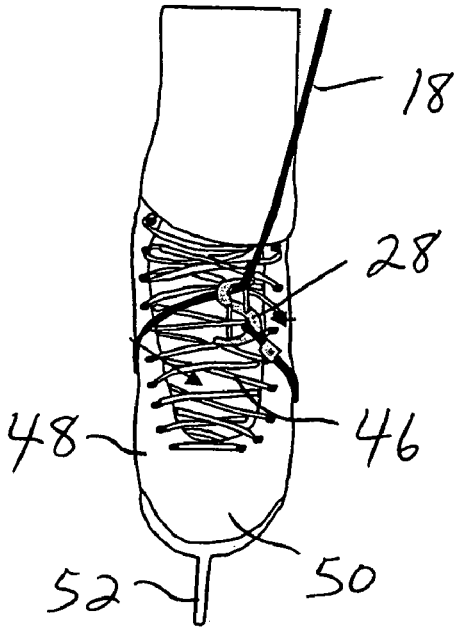
FIG. 2 illustrates an attachment of a lower section of the device to an ice skate.

FIG. 2 shows clipping mechanism 28 attached to the laces 46 of an ice skate 48. One of the loops of clipping mechanism 28, preferably loop 42 to which cord 18 is attached, is opened (by moving closure member 34) to admit laces 46. Cord 18 loops under a boot 50 of the skate but above a blade 52 (see FIG. 7), and re-enters clipping mechanism 28 forming a skate-surrounding loop with the cord. This is accomplished by manipulating closure member 32 of clip 28, to admit cord 18 into normally closed loop 40 of the clip, i.e. the one not containing laces 46. The mode of attachment is particularly convenient, because it facilitates directing cord 18 through the opening between blade 52 and the boot 50, where (unlike the case of a shoe or slipper) the loop surrounding the skate cannot simply be slipped over the toe. Further, this mode of attachment ensures that the connection derives its strength from the skate-surrounding loop, rather than depending on the connection to laces 46. The cord 18 then continues to the wrist loop. This is the recommended configuration for connecting the training device to ice skate 50. Cord 18 can be quickly and conveniently detached from the skate, by opening the cord-accommodating loop 40 to release the cord, opening the adjacent loop 42 to free the clip from laces 46, then pulling the cord away from the skate through the opening between the boot and blade.

Figure 3:
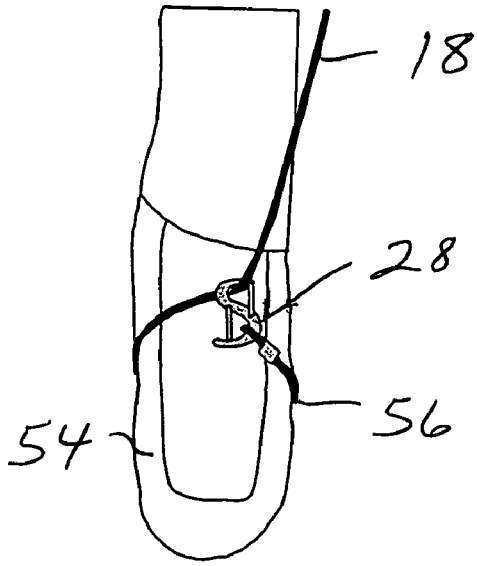
FIG. 3 illustrates an attachment of the training device to footwear without laces.

FIG. 3 shows how the quick attach and release clipping mechanism 28 is used to attach device 16 to a moccasin 54. A similar approach can be used with a shoe, a ballet slipper, or even the bare foot. Cord 18 is looped under the moccasin, slipper or shoe as indicated at 56, and re-clips into clipping mechanism 28 forming a loop with the cord. As before, closure member 32 is manipulated to insert cord 18 into loop 40 which is adjacent loop 42 connected to loop 26 at the end of the cord. It is readily apparent that the cord is secured to the moccasin or other footwear by virtue of the tension in cord 18, and does not require laces or any other portion of the footwear to establish a satisfactory releasable connection. Cord 18 then continues to the wrist loop. This is. the recommended configuration for connecting the device to bare feet, moccasins, ballet slippers or unlaced shoes.

Figure 4:
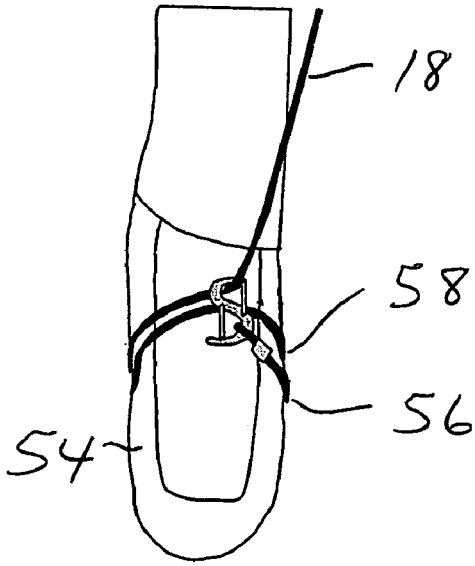
FIG. 4 illustrates an alternative, length-reducing attachment of the training device.

FIG. 4 shows an alternative attachment of device 16 to moccasin 54 or a slipper, shoe, or bare foot. Cord 18 is looped under moccasin 54 as indicated at 56, then looped or wrapped around the moccasin a second time as indicated at 58. Then, cord 18 is inserted into the clipping mechanism, this time forming a double loop around the moccasin with the cord. This effectively decreases the length of the cord continuing to the wrist loop. This is the recommended configuration for connecting and shorting the length of the device to moccasin 54, or to a skate, shoe, bare foot, or slipper.

Figure 5:
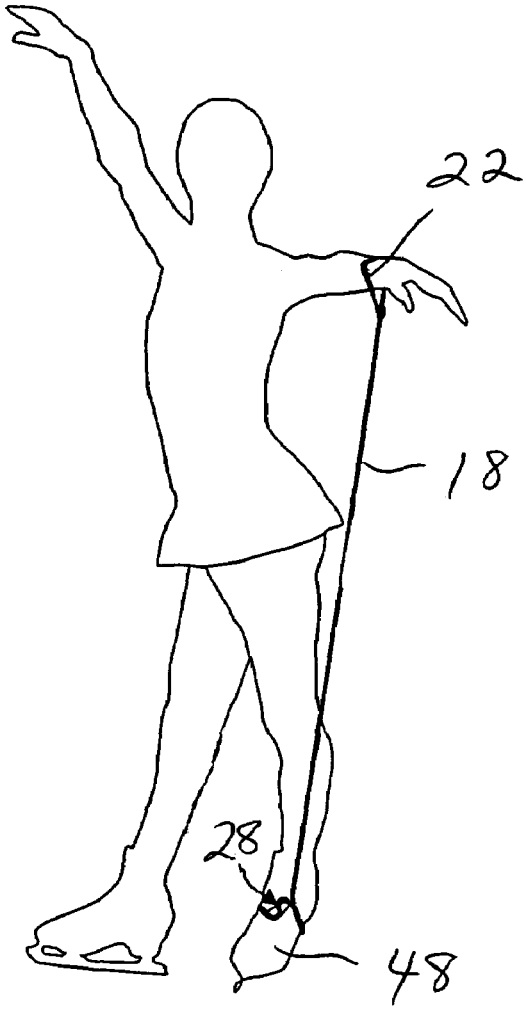
FIGS. 5–8 illustrate alternative uses of a single athletic training device in accordance with the invention.

FIG. 5 illustrates the recommended configuration for operatively linking the same side hand and foot in front of the athlete's body. Cord 18 runs from loop 22 surrounding the athlete's left wrist to left skate 48 which is surrounded by the cord. The quick attach and release clipping mechanism 28 attaches to laces of the skate as previously described, which in effect attaches the lower cord to the lower extremity (i.e. the foot). This configuration may be used for practicing camel spins or spirals.

Figure 6:
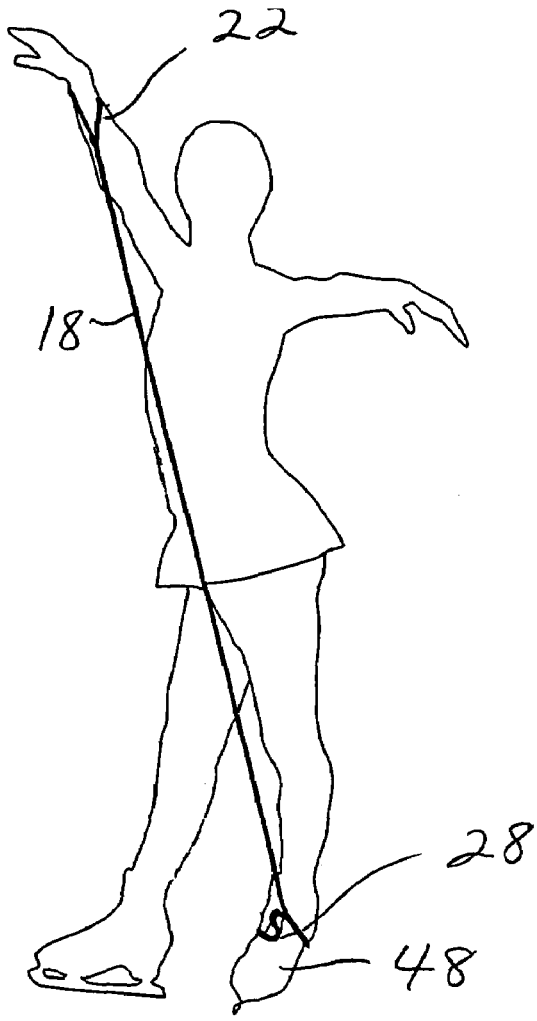

FIG. 6 illustrates the recommended configuration for connecting the opposite hand and foot in front of the body. Cord 18 runs from loop 22 surrounding the right wrist to left skate 48 which is surrounded by the cord. Clipping mechanism 28 attaches to laces of the skate, which in effect attaches the cord to the lower extremity (i.e. the foot). This configuration may be used to practice back camels, jumps or spins.

Figure 7:
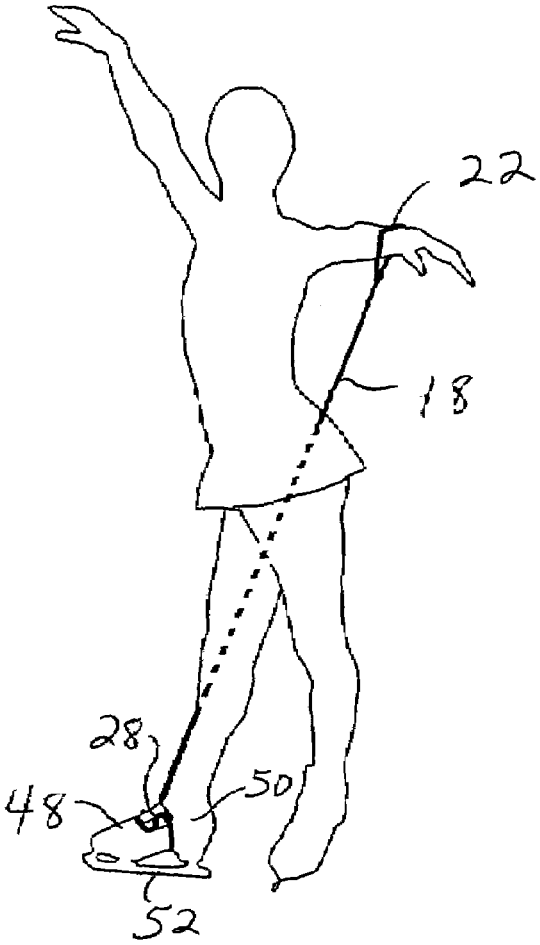

FIG. 7 illustrates the recommended configuration for connecting the opposite hand and foot, with cord 18 disposed in back of the body. Cord 18 extends from loop 22 at the left wrist loop downwardly behind the back to a right skate 48 which is surrounded by the cord. Clipping mechanism 28 attaches to laces 46 of the skate, which in effect attaches the cord to the right foot.

Figure 8:
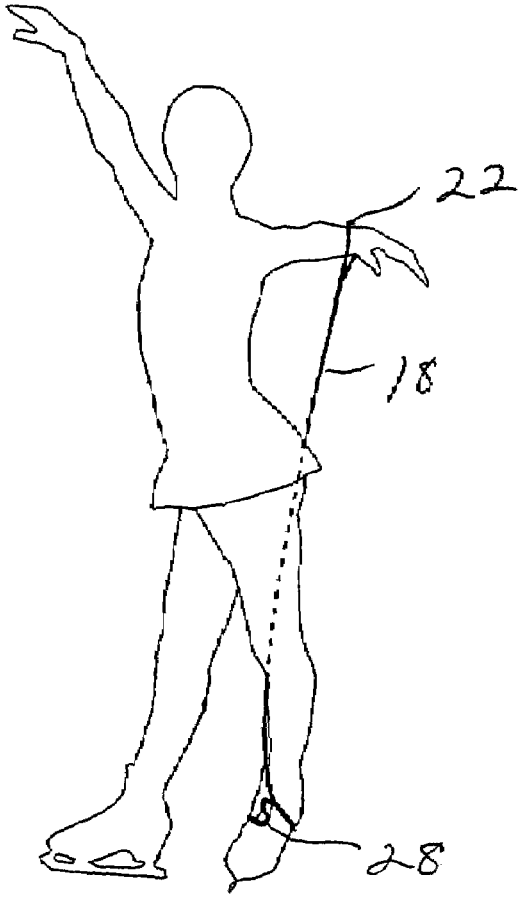

FIG. 8 illustrates the recommended configuration for connecting the same side hand and foot while disposing the cord back of the body. Cord 18 extends from loop 22 at the left wrist loop downwardly behind the back to the left skate which is surrounded by the cord. Clipping mechanism 28 attaches to laces of the skate, which in effect attaches the lower end of the cord to the left foot. With a shortened cord, this configuration may be used to practice laybacks and spirals.

Figure 9:
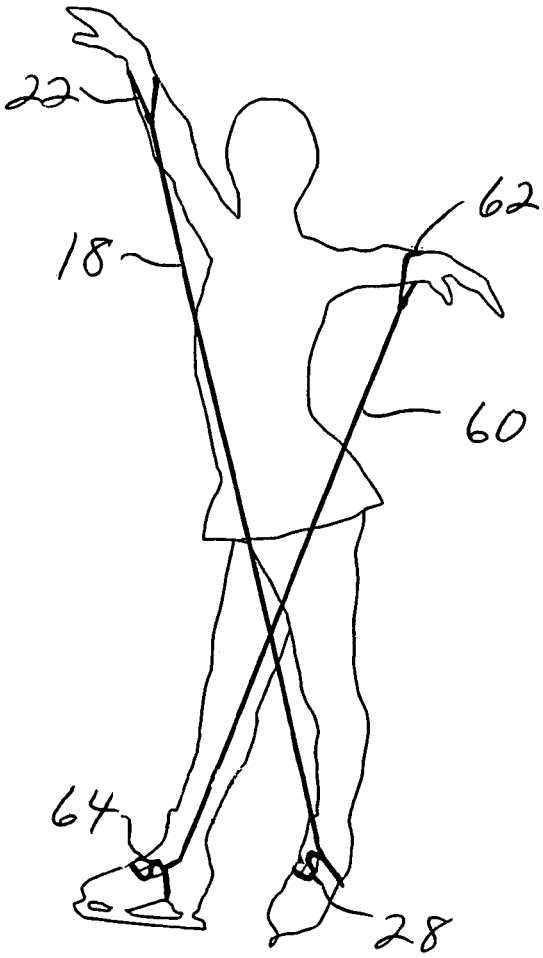
FIGS. 9–11 illustrate alternative uses for a pair of the athletic training devices.

FIG. 9 illustrates the configuration for connecting two cords to the opposite hands and feet in front of the athlete's body. Cord 18 runs from the upper extremity, the right wrist, to the left foot loop formed by the cord. Clipping mechanism 28 attaches to laces of the left skate. A cord 60 is attached by loop 62 to the left wrist, and extends to the right skate where an associated clipping mechanism 64 is attached to the skate laces, with the cord wrapped around the skate as previously described.

Figure 10:
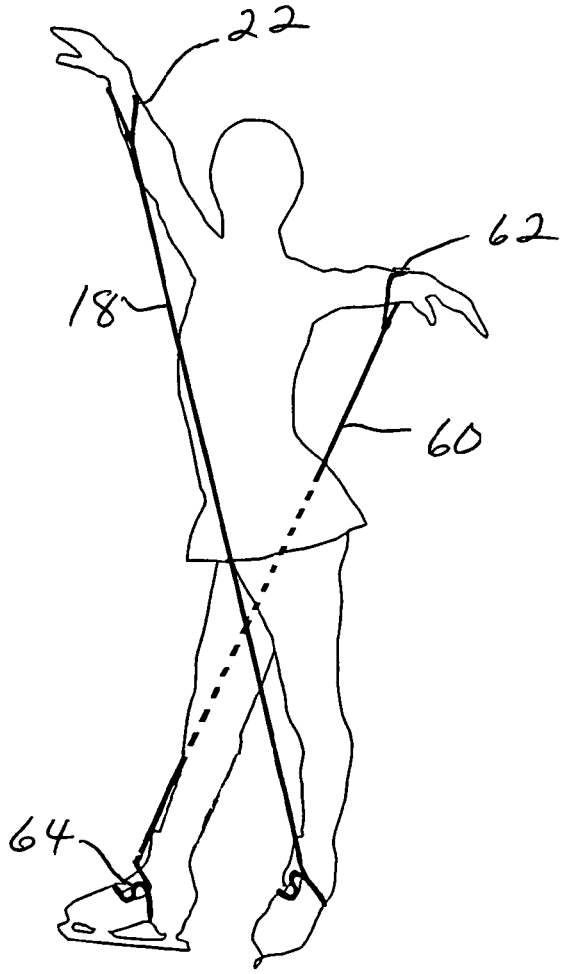

FIG. 10 illustrates a configuration for connecting two cords to the opposite hands and feet with one cord in front of the athlete's body and the other behind the body. Cord 18 extends from the right wrist in front of the body to the left foot loop formed by the cord. The clipping mechanism attaches to laces of the left skate. Second cord 60 runs from loop 62 at the left wrist, then behind the body to the right skate where the lower end of the cord is secured about the skate using clipping mechanism 64 as previously described.

Figure 11:
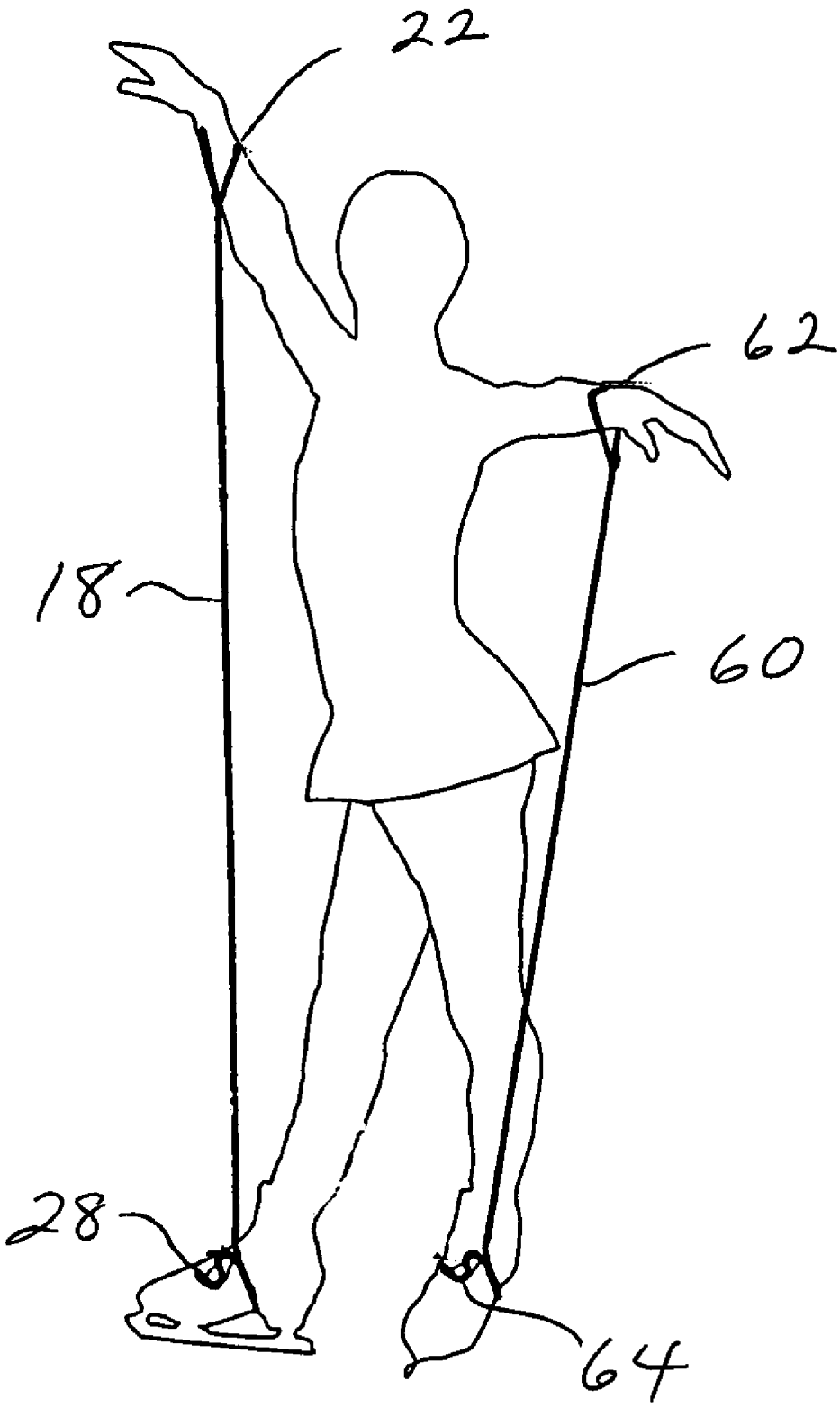

FIG. 11 illustrates a configuration for connecting two cords to the same-side hands and feet. First cord 18 runs from the right wrist to the right foot loop formed by the cord. Clipping mechanism 28 attaches to laces of the right skate. Second cord 60 extends from loop 62 surrounding the left wrist, to a bottom portion clipped to and surrounding the left skate in the manner previously described. This configuration may be used to practice stroking, crossovers, and split jumps.

The preferred resilient tension member is a cord such as a bungee-type cord. Suitable alternatives include bands, springs, and monofilament or multifilament cables. The cord is secured to itself at both ends forming loops with a fastener. The larger loop accommodates an athlete's upper extremity (wrist), typically connecting the cord to the wrist. The smaller loop provides a connection for the cord to a clipping mechanism. The clipping mechanism has spring-loaded closure members as described above for attaching to the skate, shoe, slipper or to itself to form a loop for the lower extremity (foot). An alternative clip has a generally triangular main body, and three spring-loaded closure members.

The means for securing the cord to itself to form the loops can include clips, D-rings, sleeves, knots, sewing, or circular rings or other means of securing an end of a cord to itself. These can be formed from a variety of materials including metals, plastics, wood, or ceramics.

The length of the cord can be adjusted, or cords may be provided in different lengths to accommodate the athletes with different heights and arm spans. The tensile strength of the correctly configured bungee-type cord is sufficient to provide constant tension without providing enough resistance for any substantial exercise or stress to the muscles.

The large loop 22 (upper extremity/wrist connection) may be replaced with an article other than a loop, such as a strap, band, handle, or bracelet—either resilient or inextensible.

The clipping mechanism used to attach the cord to the skate, other footwear or bare foot, an include a carabiner, D-ring, circular ring, or any other means of attaching ends of cords. Materials for this component can include metal, plastic, wood, or ceramics. Releasable attachment means such as clamps, buttons, zippers, and VELCRO hook-and-loop closures may be used in lieu of the clipping mechanism.

Use of the training device to practice skating maneuvers begins with selecting a tension member having a relaxed-state length sufficient for extension from the user's foot to the user's waist or slightly above the waist. If a cord or other tension member is too long, it can be wrapped around the skate as previously described. Then, the selected cord is secured releasably at one end to the user's skate, and at the other end about the user's wrist as illustrated in FIGS. 5–8. Alternatively, two of the cords are secured according to one of the approaches illustrated in FIGS. 9–11.

As the athlete performs a maneuver such as a jump in figure skating, tension in the cord is greater if the athlete's body is out of position. The position with the least amount of resilient cord tension is the proper position for the maneuver. As the athlete repeatedly practices the maneuver with the cord, the muscles memorizes the proper position, growing accustomed to the correct feel of the maneuver.

A salient feature of the invention is that the cords are provided with a length and flexibility particularly well suited to guide figure skaters and other athletes toward proper positioning of their hands and feet when practicing a variety of maneuvers. With reference to figure skating, the cords generally are provided at or adjusted to a length such that each cord in a relaxed state extends from the foot to about the waist as noted above. For example, the cord used by a younger athlete may be about three feet long, and for a more mature athlete may be about three feet eight inches long. Then, extension of the arm above the head when the athlete is wearing the cord involves an extension or elongation in the range of 2–3 feet beyond the relaxed length of the cord. Elongation may be in the range of sixty-five percent to eighty percent of the relaxed-state length. In other words, the extended length may range from 1.65 times to 1.8 times the relaxed-state length. Of course, extended lengths will vary with users and maneuvers.

Preferably, the tensile force in the cord, even when extended up to eighty percent beyond its relaxed-state length, is less than 15 pounds, more preferably less than 9 pounds, and most preferably less than 5 pounds. As a result, the cord allows significant freedom of movement for performing a wide variety of maneuvers, yet also provides a difference in tension sufficient to guide the athlete toward adopting the correct posture and position in connection with each maneuver.

A feature of the present invention is that cords 18 and 60 are adapted to guide the extremities toward correct relative positioning as they elongate. In other words, the guidance function of each cord coincides with an increase in tensile force during elongation. This is in contrast to previous devices in which tension is used to discourage the user from moving away from a predetermined position, such as a bent-knee position. A primary factor enabling the use of cord tension to guide rather than restrain, is the selection of tension members with low elasticities, i.e. tension members that experience substantial elongation in response to low axial force levels, as indicted above.

An added benefit is that under normal use, cords 18 and 60 are not elongated to their full elongation capabilities. For example, a cord capable of over one hundred percent elongation is elongated in actual use only up to about eighty percent, and more preferably up to about sixty-five percent. Thus, elongation of each cord during use is well below the elastic limit. Even after multiple uses, cords 18 and 60 substantially retain their original elasticities, and the tensile force generated by a given amount of cord elongation remains substantially constant.

One suitable version of cord 18 is made of an elastomer (e.g. rubber) sheathed in nylon, and has a diameter of about ⅛ inch (3.2 mm). For a better appreciation of the difference between this cord and the larger-diameter cords used in muscle strengthening applications, it is noted that a cord identical to this cord, except for having a diameter of ½ inch (12.7 mm), would exert sixteen times the tensile force of the smaller cord at a given amount of axial elongation.

The placement of the resilient cord makes the device applicable to many sports, and the simplicity of the device allows for the athlete to use the device across the front or back of the body, from the hand either to the same foot or opposite foot. In addition, a second cord can be secured to the other hand and foot, to further assist the athlete.

Once the athlete is used to the feeling of the tensile forces occasioned by stretching the cord or cords, he or she can create a desired visual effect or style.

Whether in figure skating, dancing, gymnastics, diving, in-line skating, or other positioning and alignment sports, the athlete using this device has the option of using a single cord (same hand and foot, or opposite hand and foot) crossing in front of, or behind, the body. Alternatively, two cords (same hand and foot, or opposite hand and foot) can be used. Again, the cords can cross in front of or behind the athlete.

The device is quickly attached and detached. The resilient sections are easily and quickly shortened for the smaller or younger athlete.

What is claimed is:

1. A training device for reinforcing a desired relative positioning of extremities during a gliding, spinning, twisting or jumping maneuver, including:

an elongate tension member having a nominal length when in a relaxed state, with the nominal length selected relative to a user for an extension of the tension member, when in the relaxed state, from the user's foot at least to the user's waist;

a first coupling structure adapted to releasably couple a first end of the tension member proximate to and with respect to a selected foot of the user;

a second coupling structure adapted to releasably couple a second end of the tension member proximate to and with respect to a selected hand of the user and thereby cooperate with the first coupling structure to operatively link the selected hand and selected foot through the tension member;

wherein the tension member is extensible elastically, through relative movement of the selected hand and the selected foot when so operatively linked, at least to a predetermined level of elongation corresponding to a maximum distance between the selected hand and the selected foot during a maneuver, and wherein the tension member exerts a tensile force that increases with tension member elongation to an upper-level tensile force corresponding to the predetermined level of elongation;

wherin the tension member at said predetermined level of elongation has an extended length of at least about 1.65 times the nominal length; and wherein the tension member has an elasticity selected such that the upper-level tensile force is less than a tensile force necessary for any substantial muscle exercise or muscle stress, whereby the tension member, as it is elongated during the maneuver, tends to guide the selected hand and the selected foot toward a desired relative positioning with minimal impact on freedom of movement.

2. The device of claim 1 wherein:

the tension member comprises a resilient cord.

3. The device of claim 1 wherein:

the first coupling structure comprises a clipping mechanism having at least one spring-loaded closure member.

4. The device of claim 3 wherein:

the clipping mechanism has a plurality of the spring-loaded closure members and a plurality of associated loops, each closure member being biased to close its associated loop.

5. The device of claim 1 wherein:

the second coupling structure comprises a loop formed at the second end of the tension member.

6. The device of claim 5 wherein:

said loop is resilient, and sized to accommodate a wrist of the user when in a relaxed state.

7. The device of claim 1 wherein:

the tension member at said predetermined level of elongation has an extended length of at most about 1.8 times the nominal length.

8. The device of claim 1 wherein:

the tension member when extended to a length of 1.8 times the nominal length, exerts a tensile force of less than fifteen pounds.

9. The device of claim 1 wherein:

the tension member, when extended to a length of 1.8 times the nominal length, exerts a tensile force of less than five pounds.

10. The device of claim 1 wherein:

the tension member, when extended to a length exceeding the nominal length by one-third, generates a tensile force in the range of about one pound to about five pounds.

11. A training device for reinforcing a desired relative positioning extremities during a gliding, spinning, twisting or jumping maneuver, including:

an elongate elastically extensible tension member having a nominal length when in a relaxed state;

a first coupling structure adapted to releasably couple a first end of the tension member proximate to and with respect to a selected foot of a user;

a second coupling structure adapted to releasably couple a second end of the tension member proximate to and with respect to a selected hand of the user and thereby cooperate with the first coupling structure to operatively link the selected hand and foot;

wherein the tension member is elastically extensible at least to a predetermined length of 1.8 times the nominal length, exerts a tensile force that increases with tension member elongation, and has an elasticity selected such that when at the predetermined length, the tension member exerts a tensile force of less than fifteen pounds; and wherein the tension member is extensible to an intermediate length for correspondence with a maximum distance between the selected hand and the selected foot during a manuever performed by the user with the selected hand and selected foot operatively linked through the tension member, and the selected intermediate length is at least 1.65 times the nominal length, wherein the tension member has an elasticity selected such that an upper-level tensile force corresponding to said intermediate length is less than a tensile force necessary for any substantial muscle exercise or muscle stress, whereby the tension member, as it is elongated during the maneuver, tends to guide the selected hand and the selected foot toward a desired relative positioning with minimal impact on freedom of movement.

12. The device of claim 11 wherein:

the tension member comprises a resilient cord.

13. The device of claim 11 wherein:

the first coupling structure comprises a clipping mechanism having at least one spring-loaded closure member.

14. The device of claim 13 wherein:

the clipping mechanism has a plurality of the spring-loaded closure members and a plurality of associated loops, each closure member being biased to close its associated loop.

15. The device of claim 11 wherein:

the second coupling structure comprises a loop formed at the second end of the tension member.

16. The device of claim 15 wherein:

said loop is resilient, and sized to accommodate a wrist of the user when in a relaxed state.

17. The device of claim 1 wherein:

the nominal length of the tension member is selected relative to the user whereby the tension member in the relaxed state extends from the user's foot at least to the user's waist.

18. The device of claim 17 wherein:

the tension member is extensible to an intermediate length selected for correspondence with a maximum distance between the selected hand and the selected foot during a maneuver performed by the user with the selected hand and selected foot operatively linked through the tension member, and the selected intermediate length is at most about 1.65 times the nominal length.

19. The device of claim 11 wherein:

the tension member at the predetermined length generates a tensile force of less than nine pounds.

20. The device of claim 11 wherein:

the tension member at the predetermined length generates a tensile force of less than five pounds.

21. The device of claim 11 wherein:

the tension member, when extended to a length exceeding the nominal length by one-third, generates a tensile force in the range of about one pound to about five pounds.

22. The device of claim 5, wherein:

the loop is formed by securing the elongate tension member to itself.

23. The device of claim 15 wherein:

the loop is formed by securing the elongate tension member to itself.

* * * * *